US011286632B1

(12) United States Patent
Ehsani et al.

(10) Patent No.: US 11,286,632 B1
(45) Date of Patent: Mar. 29, 2022

(54) SHEAR TRANSFER RING AND CLAMP

(71) Applicants: Mohammad R Ehsani, Tucson, AZ (US); Saeed Towfighi, Gatineau (CA)

(72) Inventors: Mohammad R Ehsani, Tucson, AZ (US); Saeed Towfighi, Gatineau (CA)

( * ) Notice: Subject to any disclaimer, the term of this patent is extended or adjusted under 35 U.S.C. 154(b) by 0 days.

(21) Appl. No.: 17/153,544

(22) Filed: Jan. 20, 2021

(51) Int. Cl.
*E02D 5/64* (2006.01)
*E02D 37/00* (2006.01)

(52) U.S. Cl.
CPC ..... *E02D 5/64* (2013.01); *E02D 37/00* (2013.01); *E02D 2250/0023* (2013.01); *E02D 2300/002* (2013.01); *E02D 2300/0026* (2013.01)

(58) Field of Classification Search
CPC combination set(s) only.
See application file for complete search history.

(56) References Cited

U.S. PATENT DOCUMENTS 3,719,049 A * 3/1973 Shaw ..... B63B 59/00 405/216
6,364,575 B1 * 4/2002 Bradley ..... E02B 17/0026 405/216
6,536,991 B1 * 3/2003 Trader ..... E02B 17/0008 405/211
8,650,831 B2 2/2014 Ehsani
9,376,782 B1 6/2016 Ehsani
9,890,546 B2 2/2018 Ehsani
10,870,999 B1 * 12/2020 Oliphant ..... E04G 23/0225
2019/0032346 A1 * 1/2019 Ehsani ..... E04G 13/023

* cited by examiner

*Primary Examiner* — Kyle Armstrong
(74) *Attorney, Agent, or Firm* — Arjomand Law Group PLLC

(57) ABSTRACT

Methods and systems are disclosed to transfer forces on a damaged pile to the lower part of the pile, bypassing the damaged area. Rings of various materials are tightly wrapped around the pile or clamps are attached to the pile, above and below the damaged area, causing calculated friction between the pile and the rings and/or clamps. Subsequently the damaged area and the rings and/or clamps are encased in a curable substance, such as concrete. After curing, the rings and/or clamps above the damaged area will receive the stresses on the pile through the friction with the pile and will transfer them to the concrete which in turn will transfer the stresses to the lower part of the pile through the lower rings and/or clamps and their friction with the lower part of the pile. Nothing is welded to the pile and the pile is not altered in any way.

20 Claims, 6 Drawing Sheets

SHEAR TRANSFER RING AND CLAMP

CROSS-REFERENCE(S) TO RELATED APPLICATION(S)

This Non-Provisional Patent Application is related to the U.S. Provisional Patent Application No. 62/748,775, entitled "Shear Transfer Ring," filed on 22 Oct. 2018, the disclosure of which is hereby expressly incorporated by reference in its entirety.

TECHNICAL FIELD

This application relates generally to repair and reinforcement of piles and columns. More specifically, this application relates to a method for replacement or creation and transfer of the required shear force between a damaged metallic pile and the concrete that is poured around the pile for reinforcement.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1A:
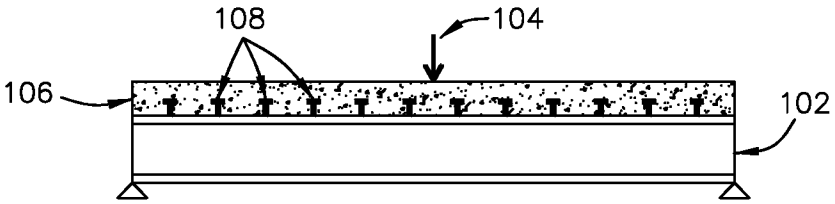
Fig. 1A (Prior Art)
FIGS. 1A, 1B, and 1C show some details of a traditional method of transferring stresses and forces between concrete and steel.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references steel piles, concrete reinforcement and steel Shear Transfer Rings and Clamps, it will be appreciated that the disclosure may include other curable and other reinforcement materials and piles made of materials other than steel to which the disclosed methods also apply. Furthermore, these methods may be utilized to repair and reinforce beams, pipes, columns and the like.

This disclosure is related to the general field of construction and in particular to the repair of columns and piles under compressive and flexural forces, some of which columns may even be submerged in water. Many such structures are damaged by corrosion after several years of service and requires strengthening. In addition, there are many columns that have to be strengthened to carry larger and heavier loads. A common method of strengthening such piles and columns is to encase them in a shell of concrete. Typical repairs require placing a formwork (or jacket), commonly made of fiberglass, around the pile and filling the annular space between the formwork and the pile with concrete. In some cases additional reinforcing bars can be placed in the annular space between the column and the formwork. Some of these formworks may even be left in place as a stay-in-place-form.

In design of structures, there are many instances where concrete and steel are designed to work in what is known as a "composite" structure to resist the external loads. This requires the stresses in concrete to be transferred to steel and vice versa. For decades, the common practice for such shear transfer has been the use of "shear connectors" or "shear studs". These shear studs are typically made of a cylindrical steel shaft like a bolt and are about 2-8 inches long. The number of these single studs, their size (diameter and length) and their spacing are designed by the engineers. The calculations are partially based on the magnitude of the loads being transferred.

In the traditional method one end of the studs is welded to the surface of the steel structure and in most projects numerous such single studs are required. Manufacturers supply these shear studs in a variety of sizes. The load transfer mechanism is primarily through bearing of concrete on the projected surface of the bolt, which can be calculated. Thus, it is advantageous to have a large projected area so more loads can be transferred per each connector/stud. The other limiting values are the shear strength of the steel bolt and the strength of the weld that connects the base of the shear connector to the steel. So, in general, the stronger the weld and the steel, the more load the stud can transfer.

Figure 1B:
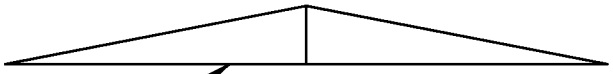
Fig. 1B (Prior Art)
Figure 1C:
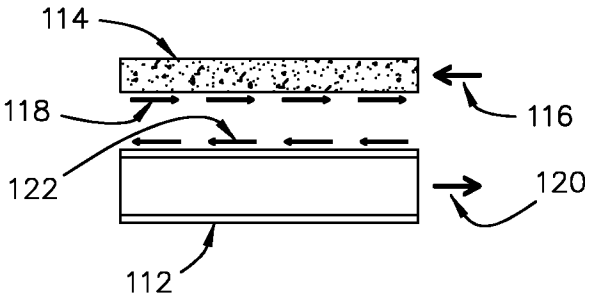
Fig. 1C (Prior Art)

FIGS. 1A, 1B, and 1C show some details of a traditional method of transferring stresses between concrete and steel. FIG. 1A shows a simply supported I-beam 102 with multiple shear studs 108 welded to it and a layer of concrete 106 that covers its surface while the layer (or deck) of the concrete 106 is encasing and enclosing shear studs 108. FIG. 1B is the classical moment diagram 110 for such beam arrangement and loading. And FIG. 1C shows free-body diagrams of the partial concrete layer 114, which is the left half of the total concrete layer 106, and the free-body diagram of the partial I-beam 112, which is the left half of the entire I-beam 102. In this example, for the sake of simplicity, the I-beam 102 is under a concentrated force 104 at its middle.

In FIG. 1C, force 116 is the compressive force exerted by the right half portion of concrete layer 106 on partial concrete layer 114 in the direction of the longitudinal axis of the concrete layer 114 and forces 118 are the shear forces acting on the partial concrete layer 114 by the partial I-beam 112. Here, the tensile force 120 is acting on the partial I-beam 112 by the right half of the I-beam 102 and the forces 122 are the shear forces acting on the surface of the partial I-beam 112 by the partial concrete layer 114. The shear studs 108 are the main instruments resisting the slippage of the partial concrete layer 114 on the surface of the partial I-beam 112; the slippage that can be caused by shear forces 118 and 122.

In the traditional method, there are other design parameters that engineers consider as well, for example, the spacing between adjacent studs. In general, if the studs are too closely spaced, there is a loss of strength; i.e., the contribution of three closely-spaced cluster of studs becomes less than the sum of the strength of each of the three studs if they were installed with a larger spacing between them. These shear connectors or studs are used in all kinds of structural elements, such as columns, walls, beams, sheet piles, pipe, etc. and they can transfer loads that are produced from dead load, live load, earthquake, wind, temperature, shrinkage, fluid pressure and the like.

In some projects, for example, the engineers are tasked with the design of shear studs to transfer the loads from a cylindrical steel pile to concrete. Such steel piles, which are manufactured from steel tubes (pipes) with or without filling the inside with concrete, are often used in construction of supports for ports and piers. With aging, the steel tube corrodes and requires to be repaired. In some cases, the loading on the pile is increased and a strengthening beyond the original capacity is required so the pile can resist the new loads safely. Such applications require casting a tube of concrete (1-4 inches thick) around the host steel pile. Examples of these reinforcements are disclosed in detail in some of the inventor's patents and patent applications such as U.S. Pat. Nos. 8,650,831; 9,376,782; and 9,890,546.

As mentioned above, because the steel surface of the piles slips relative to the adjacent concrete, the transfer of the load between the concrete and steel in such repairs requires the use of shear studs or shear connectors. However, there are several problems associated with the use of welded shear studs as listed below:

1. Because some of these repairs are performed underwater, welding of shear studs is extremely expensive, and the quality of workmanship performed by the divers cannot be guaranteed.
2. The original steel pile may be corroded, resulting in reduction of the steel thickness and welding will further damage the steel pile.
3. Many sites, such as industrial ports and oil refineries, prefer or demand not to use welding for safety reasons. Unlike the cases shown in FIG. 1, where the welding can be performed off-site, for these existing structures the welding that has to be performed onsite is a safety concern and objectionable.
4. In some of these projects the cylindrical steel pile is hollow inside; welding may result in holes that will fill the pile with water and that water may cause further damage to the pile.

Shear Transfer Ring

Figure 2B:
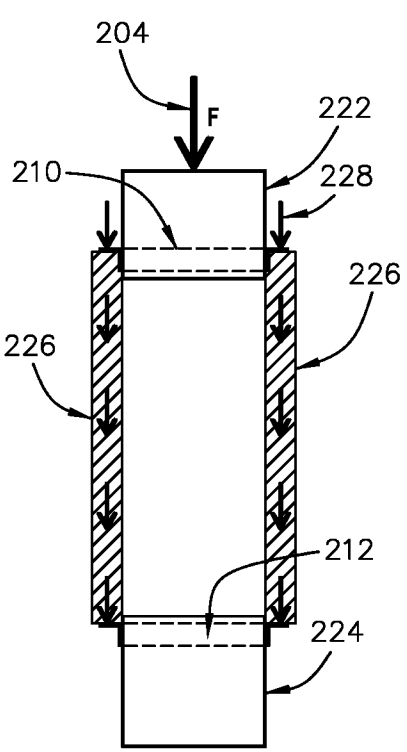
FIG. 2B illustrates the mechanism of transferring the compressive force of FIG. 2A, which acts on the pile, to the concrete surrounding the damaged part of the pile.
Figure 2A:
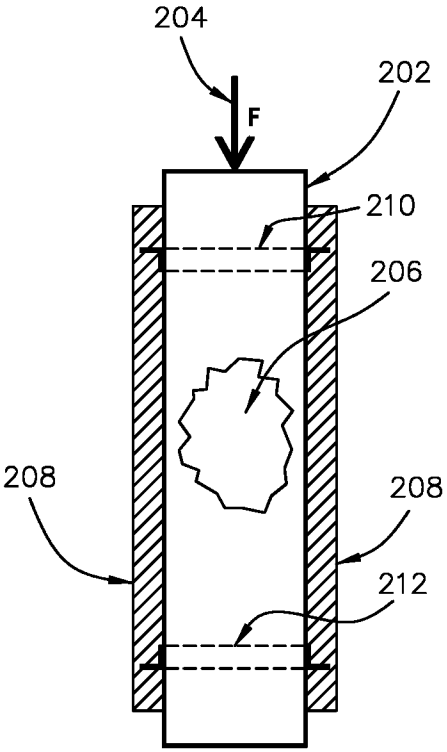
FIG. 2A illustrates an example of using Shear Transfer Rings to transfer a compressive force exerted on a damaged steel pile to the concrete surrounding the pile.

To overcome the above shortcomings of the traditional methods, a new technique that utilizes a Shear Transfer Ring (STR) is disclosed below which replaces the individually welded shear connectors or shear studs. The method presented here is particularly well suited for cylindrical or oval-shaped structures such as piles, columns and pipes, although it can be applied to structures of any cross-sectional shape such as H and I cross-section. The physics principal (friction forces) that the disclosed method is based on is totally different from the physics principal (shear forces) employed in the method using shear connectors or shear studs. FIGS. 2A and 2B schematically describe the physics principal (friction forces) that the disclosed method is based on.

FIG. 2A illustrates an example of using Shear Transfer Rings 210 and 212 to transfer a compressive force 204, exerted on a damaged steel pile 202, to the concrete 208 surrounding the damaged part 206 of the pile 202. In this example the Shear Transfer Rings 210 and 212 are made of right angle steel profile, as shown in FIG. 2A.

FIG. 2B illustrates the mechanism of transferring the compressive force 204 of FIG. 2A that acts on the pile 202 to the concrete 208 surrounding the damaged part 206 of the pile 202 and bypassing the damaged part 206. Assuming that the damaged part 206 has no load bearing capacity, the partial section 222 of pile 202, which is tightly held by the Shear Transfer Ring 210, is in effect sitting on the partial middle section 226 of concrete 208. In this situation, the Shear Transfer Ring 210 is transferring the load of the partial section 222 of pile 202 and the force 204 to the partial middle section 226 of the concrete 208. And in turn, the partial middle section 226 of the concrete 208 is transferring this load and its own weight, via the Shear Transfer Ring 212, to the partial section 224 of pile 202 and therefore to the foundation under the pile 202.

Among the factors that will be discussed in the following paragraphs, two of the more important variables that determine the contribution of the STR are the following:

1. The tension force in the STR that is wrapped around the pile. This determines the friction force between the STR and the host pile.
2. The area of the STR that extends outwardly (usually perpendicular) away from the surface of the pile.

The Tension Force

In the traditional method, the transfer of loads from the studs to the steel structure is achieved through shear forces attained by the weld. In the disclosed STR system, these forces are transferred by means of friction. As it is known to those in this field, friction force is calculated as:

$F=\mu N$, where

F=Friction Force

N=Normal force, and

μ=Coefficient of Friction between the two surfaces coming in contact

Figure 3C:
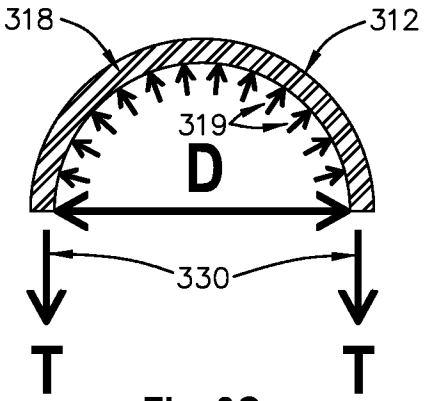
FIGS. 3A, 3B, and 3C show an example of the forces involved in a reinforcement system made according to the disclosed methods.
Figure 3B:
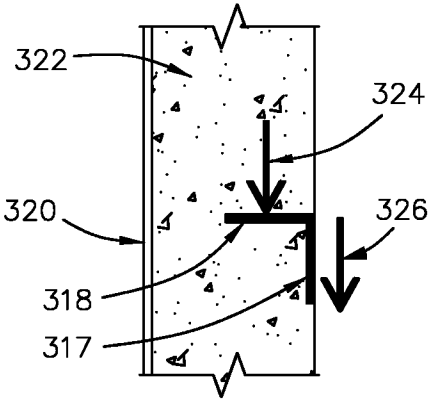
Figure 3A:
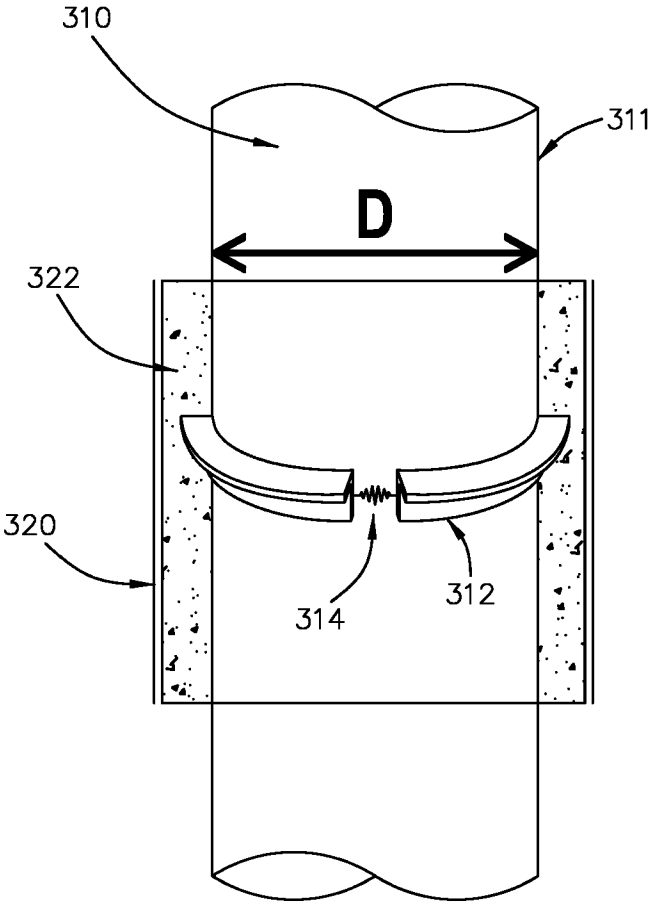

FIGS. 3A, 3B, and 3C show an example of the forces involved in a reinforcement system made according to the disclosed methods.

FIG. 3A, which is similar to the lower part of FIG. 2A, illustrates an example steel pile 310, with a diameter of "D" and a steel skin surface 311. Steel pile 310 is partially enveloped by a concrete jacket 322 which has been poured inside formwork 320. In different embodiments other flowable filler material such as resin, grout, foam, etc. may be used. In this example the steel skin surface 311 is damaged and the pile 310 needs to be repaired by the disclosed method. The steel pile 310 had been tightly wrapped by a STR 312 before concrete 312 is poured. In this example the STR 312 is made of an angle steel that is tightened around pile 310 by a tensioning mechanism 314, which may be as simple as a bolt and a nut. By tensioning the fastener 314, a tension force "T" is induced in the STR 312 and a portion of the STR 312 comes substantially in contact with the steel skin surface 311 and a portion of the STR 312 projects outwardly, away from the surface of the pile 310.

FIG. 3B shows a close up view of a small portion of the concrete jacket 322 and of the formwork 320. As discussed with respect to FIGS. 2A and 2B, the forces on the pile 310 are transferred by concrete jacket 322 through bearing stresses 324 to the protruding area 318 of the STR 312. These forces are transferred to the skin surface 311 of the pile 310 through frictional forces 326, all around the perimeter of the STR 312. The normal forces 319 of FIG. 3C, which are described in more detail below, determine the friction force 326.

FIG. 3C shows a free body diagram of one half of the pile 310 with the STR 312 positioned around it. The tension forces 330, "T", in this figure are the same as the tension force in the bolt or fastener 314. This tension force 330 results in a series of normal stresses 319 acting on the area 317 of the STR 312 that is in contact with the surface skin 311 of the pile 310. By integrating the stress components, it can be shown that the total normal force (N) acting on half of the STR is 2T and that acting on the full (360 degrees) is 4T. Thus the previous relationship can be written as:

$$F=\mu N=\mu(4T)=4\mu T$$

In this expression, it can be shown that F is the sum of all friction forces 326 around the pile 310 (i.e. 360 degrees all around the pile). Therefore, the maximum force that each STR 312 can transfer by means of friction 326 to the skin 311 of the pile 310 is equal to 4 μT. Therefore, it is clear that by increasing the tension force "T", one can bypass the damaged area of the pile 310 and transfer a larger load to the lower portion of the pile 310. Thus, it is best to build the STR with a high strength material (e.g. steel) and tighten the STR with a large tension force in the fastener 314.

It is also evident that a higher coefficient of friction is more desirable. Thus a rusted skin surface 311 of pile 310 offers more friction and a higher friction force compared to a cleaned "white metal" finished surface.

The Projected Bearing Area

The second variable in the disclosed system is the area 318 of the STR 312 that projects outward and away from the surface 311 of pile 310. As shown in FIG. 3B, this lip 318 receives the localized bearing forces 324 from the concrete 322 and transfers them via friction force 326 to the skin 311 of pile 310. Allowable bearing stress in concrete is around 55% of its compressive strength. Therefore, the larger the area of lip 318, the more load on the pile 310 can be tolerated and transferred by the concrete jacket 322.

The STR can be made with a variety of products, such as steel angles, chains, high-strength cables (such as those used in post-tensioning), links that are in the shape of an arc of a circle and their ends are pinned together, etc. The STR described above can also be constructed in a variety of shapes and with numerous products while in all cases the mechanism of load transfer remains the same, namely bearing on the protruding projected area and friction that is achieved by tightly wrapping and tensioning the STR around the host pile.

Figure 4:
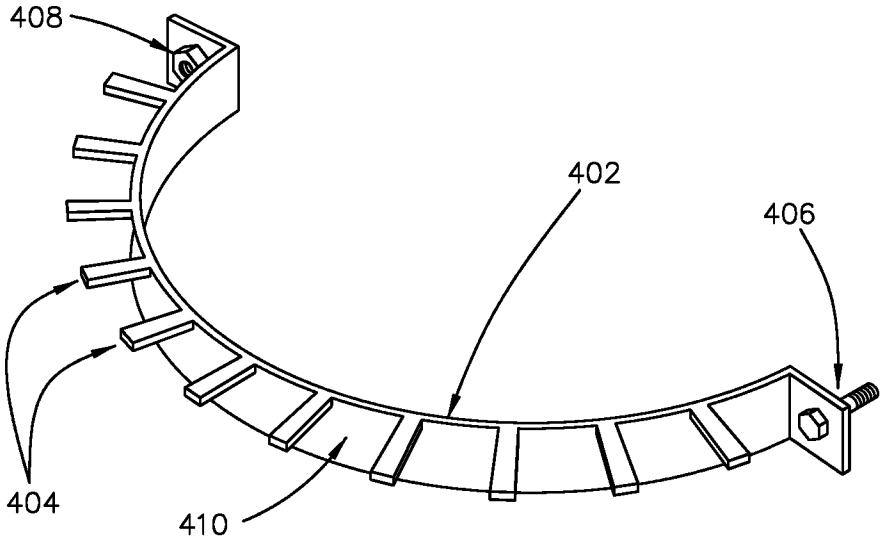
FIG. 4 shows an example Shear Transfer Ring that is made of an angle bar of steel.

FIG. 4 shows an example Shear Transfer Ring 402 that is made of an angle bar of steel. The flat-bar portion 410 of the steel angle that will come in contact with surface of the pile, will have a bolt 406 attached to one end that has been bent 90 degrees (or welded to the end of the flat-bar portion 410) and a nut 408 attached to the other end, which has also been bent or welded. Some sections of the other flat side of the angle iron have been cut off and removed to form the protruding fingers 404 that will be encased in the concrete jacket. Cutting and removing some of the steel areas makes the angle more flexible so it can be more easily wrapped around the pile. As the STR is wrapped around a pile, the uncut legs/fingers 404 will protrude outwardly from the surface of the pile and the above mentioned bolt 406 and nut 408 at the two ends of STR 402 will be used to tightly wrap the angle around the steel pile. The tension force in the bolt determines the force "T" that was discussed in relation to FIG. 3C and the legs/fingers 404 that cantilever out, away from the pile surface, act as the bearing area 318 discussed above.

Figure 5:
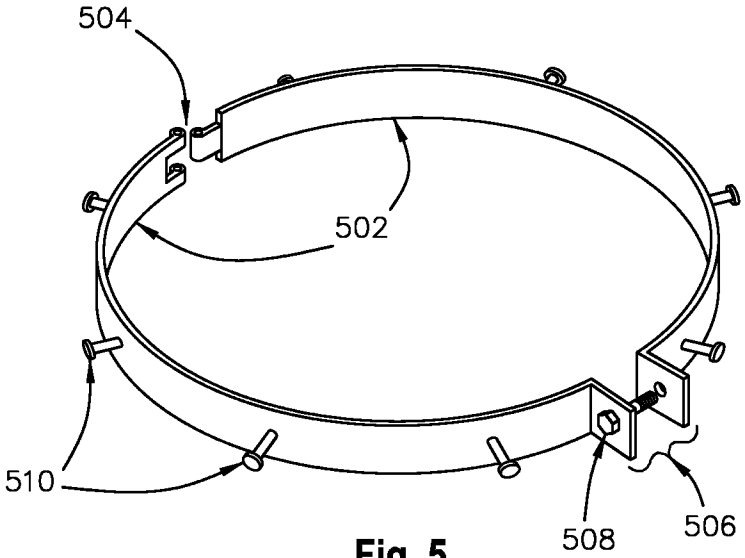
FIG. 5 shows some details of an example Shear Transfer Ring and its components, according to another embodiment of the disclosed method.

FIG. 5 shows some details of an example Shear Transfer Ring 502 and its components according to an embodiment of the disclosed method. Here the illustrated example STR 502 is made of two curved flat bars with a width "w" and a thickness "t", where the width of the STR 502 extends horizontally out and helps in transferring the bearing stresses from concrete to the flat-bar. However, in this example a number of studs 510 or other protruding shapes have been attached, fastened or welded to facilitate the transfer of bearing stresses from concrete to the flat-bar. As seen in this example, the STR may be made of two or more segments that can be connected by pins, hinges 504 and/or bolts 508. Here the ends 506 are puled towards each other using the bolt 508 or other tensioning means.

In various embodiments, the tensioning force in the tensioning device can be monitored to remain at desired level. This can be done, for example by using a torque wrench to accurately tighten the bolt 508 to the desired level. Another option is to use a Tension Control Bolt. These bolts have a piece at the end of the shank that breaks off when the predetermined tension force in the bolt is reached. This guarantees the tension force in the bolt is as it was calculated in the design.

In the above embodiments various example configurations and materials for an STR have been described with different advantages. For example, a cable is very flexible and can be easily conform to the shape of the pile. It is also easier to cut a cable STR to the required length in the field from a long roll of chain. The option in FIG. 4 allows change of the area of the fingers 404 so that a larger load can be carried on the pile.

Figure 6:
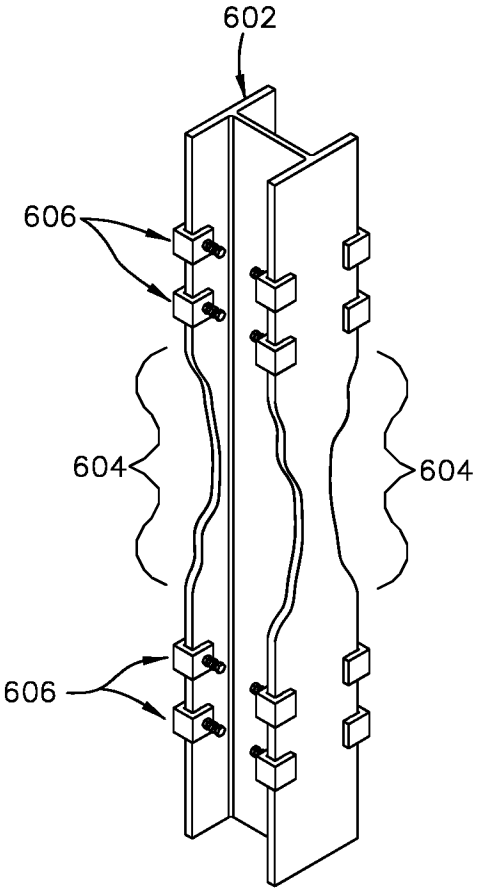
FIG. 6 shows an example Shear Transfer Clamp used for piles with H or I or similar cross-sections.

FIG. 6 shows an example shear transfer clamp used for piles with H or I or similar cross-sections. The same disclosed concept and method can be applied to the columns and piles of various shapes and cross-sections. FIG. 6 illustrates a damaged H-pile 602. To create friction forces on the surface of H-pile 602, for example C-clamps 606 or any other forms of clamps are attached to the flange of H-pile 602, above and below the damaged area 604. In this case, the tightening (tensioning) of the bolt(s) in the C-clamps produces the normal stresses described above that result in development of friction forces between the C-clamp 606 and the pile 602. The shear transfer capacity of each C-clamp can be calculated based on the geometrical properties of the C-clamp and the tensioning (tightening) force used to secure the C-clamp 606 to the pile 602. After the attachment of C-clamps 606, a formwork is fashioned around the H-pile 602 and a desired flowable and curable material is poured in the space between the formwork and the pile 602 such that to encase a portion of the pile 602 and the C-clamps 606. In this example embodiment the C-clamps 606 act in the same way as the Shear Transfer Rings did in the previous examples and transfer the forces exerted on the pile 602 to the lower portion of the pile 602 by sidestepping the damaged area 604.

In some embodiments the STR may be glued to the pile in addition to or instead of tightening it around the pile. In other embodiments the surface of the STR or of the clamps that are in contact with the surface of the pile may be roughened by different methods to increase the friction between the surface of the STR or of the clamps and the surface of the pile. In various embodiments the part of surface of the pile that is in contact with the surface of the STR or of the clamps may be coarsened.

In some embodiments the frictions between the STR(s) and the pile, at the location of wrapping(s), is calculated such that on each side of the damaged area the total friction is a desired fraction of or is equal to or is a desired multiple of the total load on the pile.

In some embodiments in which the entire lower part of a pile is damaged, the STR(s) may be wrapped around the pile above the damaged area and encase the pile in reinforcement material that encloses the STR(s) and continues all the way to the foundation on which the pile is erected or all the way to another stationary platform that can support the loads imposed on the pile. Such method transfers the forces exerted on the damaged pile to the foundation of the pile or the stationary platform through the encasement material and bypasses the damaged part of the pile. The tension in the STR(s) is/are calculated to provide a desired friction force between the pile and the STR(s) such that the (total) friction force is a desired fraction of or a desired multiple of or equal to the forces exerted on the pile.

Design Example

The simplified example provided here is intended to demonstrate some of the key steps in designing a STR in accordance to the disclosed technique. Given the following information about a cylindrical steel pile being repaired calculate the amount of force that can be transferred through a STR that is constructed with the following cable wrapped around the pile:

D=pile diameter=24 inches

Concrete shell thickness=2 inches

Compressive strength of concrete=$f'_c$=4,000 psi

Cable used=7-wire high-strength strand with $f_{pu}$=270 ksi (commonly used in post-tensioning)

Cable Diameter=0.5 inch

Cable cross section area=0.153 in.$^2$

The capacity of the STR based on Tension Force and Projected Bearing Area will be calculated and the lower number will control the design.

a) Tension Force

Assume cable can be stressed to 70% of its ultimate strength of 0.7×270 ksi=189 ksi. T=0.153×189=28.9 kips=the force in the bolt pulling the ends of the cable towards each other Assume μ=0.4 for steel to steel contact.

$$F=4\times0.4\times28.9 \text{ kips}=46.2 \text{ kips}$$

b) Projected Bearing Area

Due to the round shape of the cable, conservatively assume that the projected profile of the cable is:

0.8×0.5 in.=0.4 in. wide.

Perimeter or total length of the cable=24 in.× 3.14=75 in.

Projected Bearing Area=75×0.4=30 in.$^2$

Bearing Force=(0.55×4,000 psi)×30 in.$^2$=66,000 pounds=66 kips

In this case, the capacity of the STR is 46.2 kips which is the smaller of the two numbers. Thus, if we wish to transfer a force of 130 kips from the concrete to the pile, we need 130 kips÷(46.2 kips/STR)=2.81 STR or rounded to the next whole number, three (3) STR units.

In the above example, losses in the prestressing cable as it wraps around the pile have been ignored. Also, as engineers know, there are other calculations that must be performed to make sure the steel pile does not fail because of the tensioning force. If this happens, a smaller tensioning force can be used which could dictate more STR units. Another alternative is to use a flat bar similar to FIG. 5, instead of the steel cable.

While the foregoing discussion and example have focused on axial compressive loads being applied to a pile, those skilled in the art realize that the same system of load transfer can be achieved when the host structure is subjected to other loads and stresses that induce, tension, flexure, or shear in the host structure.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B," and also the phrase "A and/or B" will be understood to include the possibilities of "A" or "B" or "A and B."

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A method of transferring all or some of forces exerted on a first section of a pile to a second section of the pile, bypassing a third section of the pile that is between the first and the second section of the pile, the method comprising:

wrapping a first strip of a desired material around the first section of the pile, wherein a tension in the first strip is calculated to provide a first desired friction force between the pile and the first strip;

wrapping a second strip of the same or another desired material around the second section of the pile, wherein a tension in the second strip is calculated to provide a second desired friction force between the pile and the second strip;

encasing the third section of the pile in a curable substance of a desired thickness or a calculated thickness such that the first strip and the second strip are also encased in the curable encasement of the third section; and wherein a force acting on the first section of the pile is transferred by the first friction force to the first strip and therefrom is transferred by compressive force to the encasement and from the encasement by compressive force is transferred to the second strip and therefrom by the second friction force to the second section of the pile, while bypassing the third section of the pile.

2. The method of claim 1, wherein lengths of the first and the second strip is shorter than circumferences of the pile locations around which the strips are wrapped.

3. The method of claim 2, wherein to accomplish the calculated tensions in the strips both ends of each strip is pulled towards each other by forces equal to the calculated tensions and secured in pulled positions.

4. The method of claim 1, wherein the strips are made of a single piece or multiple pieces.

5. The method of claim 4, wherein the multiple piece strips have multiple pulling mechanisms.

6. The method of claim 1, wherein the calculated tensions in the strips are caused by pulling both ends of each strip towards each other by tightening a bolt.

7. The method of claim 1, wherein more than one strip is wrapped around the first undamaged part of the pile and/or more than one strip is wrapped around second undamaged part of the pile and wherein the tension in each strip is calculated such that the total friction force in the first undamaged part of the pile and the total friction force in the second undamaged part of the pile are a desired fraction of or a desired multiple of or equal to the force acting on the first undamaged part of the pile.

8. The method of claim 1, wherein the strip is made of cable, wire, chain, or metal profiles.

9. The method of claim 8, wherein the strip is made of more than one piece and the pieces are linked together.

10. A method of transferring forces exerted on a damaged pile to a support platform, via an enclosing reinforcement material, the method comprising:

wrapping the pile, above damaged area(s) of the pile, a strip of a desired material, wherein a tension in the strip is calculated to provide a desired friction force between the pile and the strip and wherein the friction force is a desired fraction of or a desired multiple of or equal to the forces exerted on the pile; and enclosing the pile in the reinforcement material such that the reinforcement material encloses at least from the strip to the support platform, wherein the forces exerted on the damaged pile are transferred by the friction force to the strip and from the strip by compressive force to the reinforcement material and from the reinforcement material are transferred by compressive force to the support platform.

11. The method of claim 10, wherein the strip is made of a single piece or multiple pieces.

12. The method of claim 11, wherein the multiple piece strip has multiple pulling mechanisms.

13. The method of claim 10, wherein the calculated tensions in the strip is caused by pulling both ends of each strip towards each other by tightening a bolt.

14. The method of claim 10, wherein more than one strip is wrapped around the undamaged part of the pile and wherein the tension in each strip is calculated such that the total friction force between the strips and the pile is a desired fraction of or a desired multiple of or equal to the force acting on the pile.

15. A method of transferring forces between a pile with any cross-section and its enclosing reinforcement material, using friction forces, the method comprising:

clamping a desired location of the pile with at least one first clamp of a desired mechanism and material, wherein forces between the first clamp and the pile are calculated such that to provide a desired friction force between the first clamp and the pile;

enclosing a section of the pile in the reinforcement material such that the first clamp is also enclosed in the reinforcement material; and supporting the reinforcement material, from below, by a support platform or by a second clamp attached to the pile or by a strip wrapped around the pile, wherein a calculated portion of forces applied to the pile are transferred by the friction force between the first clamp and the pile to the enclosing reinforcement material and therefrom to the supporting platform, to the second clamp, or to the strip.

16. The method of claim 15, wherein the pile cross-section is H or I shape.

17. The method of claim 16, wherein the first and/or the second clamp is attached to flange of the H or I pile.

18. The method of claim 15, wherein the first and/or the second clamp is a C-clamp.

19. The method of claim 15, wherein the pile is damaged and the first clamp is attached to the pile above a damaged area and the second clamp is attached to the pile below the damaged area and wherein the friction force over the damaged area and the friction force under the damaged area are calculated such that a desired fraction of or a desired multiple of or equal to forces exerted on the pile.

20. The method of claim 19, wherein any desired fraction of forces to remain on the pile section between the first and the second clamp is calculated.

* * * * *